US008317197B2

(12) United States Patent
DeGruchy

(10) Patent No.: US 8,317,197 B2
(45) Date of Patent: Nov. 27, 2012

(54) APPARATUS AND METHOD FOR IMAGE PRODUCTION DEVICE MEDIA HOLD DOWN TRANSPORT AIR FLOW

(75) Inventor: Paul J. DeGruchy, Hilton, NY (US)

(73) Assignee: Xerox Corporation, Norwalk, CT (US)

( * ) Notice: Subject to any disclaimer, the term of this patent is extended or adjusted under 35 U.S.C. 154(b) by 204 days.

(21) Appl. No.: 12/713,810

(22) Filed: Feb. 26, 2010

(65) Prior Publication Data

US 2011/0210504 A1 Sep. 1, 2011

(51) Int. Cl.
*B65H 5/16* (2006.01)

(52) U.S. Cl. ..... 271/276; 271/197

(58) Field of Classification Search ..... 271/197, 271/276, 96, 108; 198/283, 284, 197, 471.1, 198/697.1

See application file for complete search history.

(56) References Cited

U.S. PATENT DOCUMENTS 4,926,199 A * 5/1990 Bibl et al. ..... 347/116
5,833,231 A * 11/1998 Schreiner ..... 271/197
6,254,092 B1 * 7/2001 Yraceburu et al. ..... 271/276
6,497,522 B2 * 12/2002 Wotton et al. ..... 400/578
6,682,238 B2 * 1/2004 Yraceburu et al. ..... 400/635
6,981,766 B2 * 1/2006 Tsuji ..... 347/104
7,182,334 B2 2/2007 Spence et al.
2010/0276879 A1 * 11/2010 Bober ..... 271/276

* cited by examiner

*Primary Examiner* — Jeremy R Severson
(74) *Attorney, Agent, or Firm* — Ronald E. Prass, Jr.; Prass LLP

(57) ABSTRACT

An apparatus (100) and method (300) for media hold down transport air flow in an image production device is disclosed. The apparatus can include a media transport belt (110) configured to transport media sheets (105) in a process direction (116). The media transport belt can include a plurality of belt apertures (115) arranged along a cross-process direction (118), where the cross-process direction is perpendicular to the process direction. The plurality of belt apertures can be configured to conduct air to secure the media sheets on the media transport belt. The apparatus can include a vacuum plenum assembly (120). The vacuum plenum assembly can include a plurality of plenum apertures (125) arranged along the cross-process direction. The plurality of plenum apertures can be configured to conduct air through at least some of the plurality of belt apertures. The plurality of plenum apertures can include at least a first plenum aperture (121) of a first width (123) in the cross-process direction and at least a second plenum aperture (122) of a second width (124) in the cross-process direction, where the first width can be different from the second width. The apparatus can include a media transport shift assembly (130) configured to shift a relative position between the media transport belt and the vacuum plenum assembly in the cross-process direction to align at least some of the plurality of belt apertures with at least some of the plurality of plenum apertures.

19 Claims, 12 Drawing Sheets

APPARATUS AND METHOD FOR IMAGE PRODUCTION DEVICE MEDIA HOLD DOWN TRANSPORT AIR FLOW

BACKGROUND

Disclosed herein is an apparatus and method for image production device media hold down transport air flow.

Presently, image output devices, such as printers, multi-function media devices, xerographic machines, ink jet printers, and other devices produce images on media sheets, such as paper, substrates, transparencies, plastic, or other media sheets. To produce an image, marking material, such as toner, ink jet ink, or other marking material, is applied to a media sheet to create an image on the media sheet.

In image output devices, it is common to transport media sheets from one processing station to another, for example from an image transfer station at a photoreceptor to a fuser in a xerographic machine. Typically, such sheet transporting uses conventional multi-belt vacuum belt transport systems. Substantial vacuum pressure is applied from a vacuum plenum through holes in each vacuum belt and in a concentrated manner onto an image carrying substrate being transported. Such substantial vacuum pressure is desirable in order to provide adequate control over each such substrate or sheet. Furthermore in other applications where vacuum belt transport systems are used to transport sheets under direct marking print heads, maintaining a high degree of sheet flatness and excellent motion control are required.

Unfortunately, open port leakage created by running sheets smaller than the plenum width reduces the hold down pressure available to hold the sheets flat. Current systems use multiple chambers with separate air sources or impedance balancing to reduce the pressure drop. However, separate air sources are expensive and can limit the subdivision across the transport width. Furthermore, impedance balancing can help reduce the leakage, but it also reduces the acquisition flow for the wider sheets. Internal cross process chamber gating or valving can also be implemented. However, internal cross process chamber gating and valving requires a very low impedance to air flow and can get very complex if multiple chambers are incorporated along the process length.

Thus, there is a need for an apparatus and method for media hold down transport air flow in an image production device.

SUMMARY

An apparatus and method for media hold down transport air flow in an image production device is disclosed. The apparatus can include a media transport belt configured to transport media sheets in a process direction. The media transport belt can include a plurality of belt apertures arranged along a cross-process direction, where the cross-process direction is perpendicular to the process direction. The plurality of belt apertures can be configured to conduct air to secure the media sheets on the media transport belt. The apparatus can include a vacuum plenum assembly. The vacuum plenum assembly can include a plurality of plenum apertures arranged along the cross-process direction. The plurality of plenum apertures can be configured to conduct air through at least some of the plurality of belt apertures. The plurality of plenum apertures can include at least a first plenum aperture of a first width in the cross-process direction and at least a second plenum aperture of a second width in the cross-process direction, where the first width can be different from the second width. The apparatus can include a media transport shift assembly configured to shift a relative position between the media transport belt and the vacuum plenum assembly in the cross-process direction to align at least some of the plurality of belt apertures with at least some of the plurality of plenum apertures.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
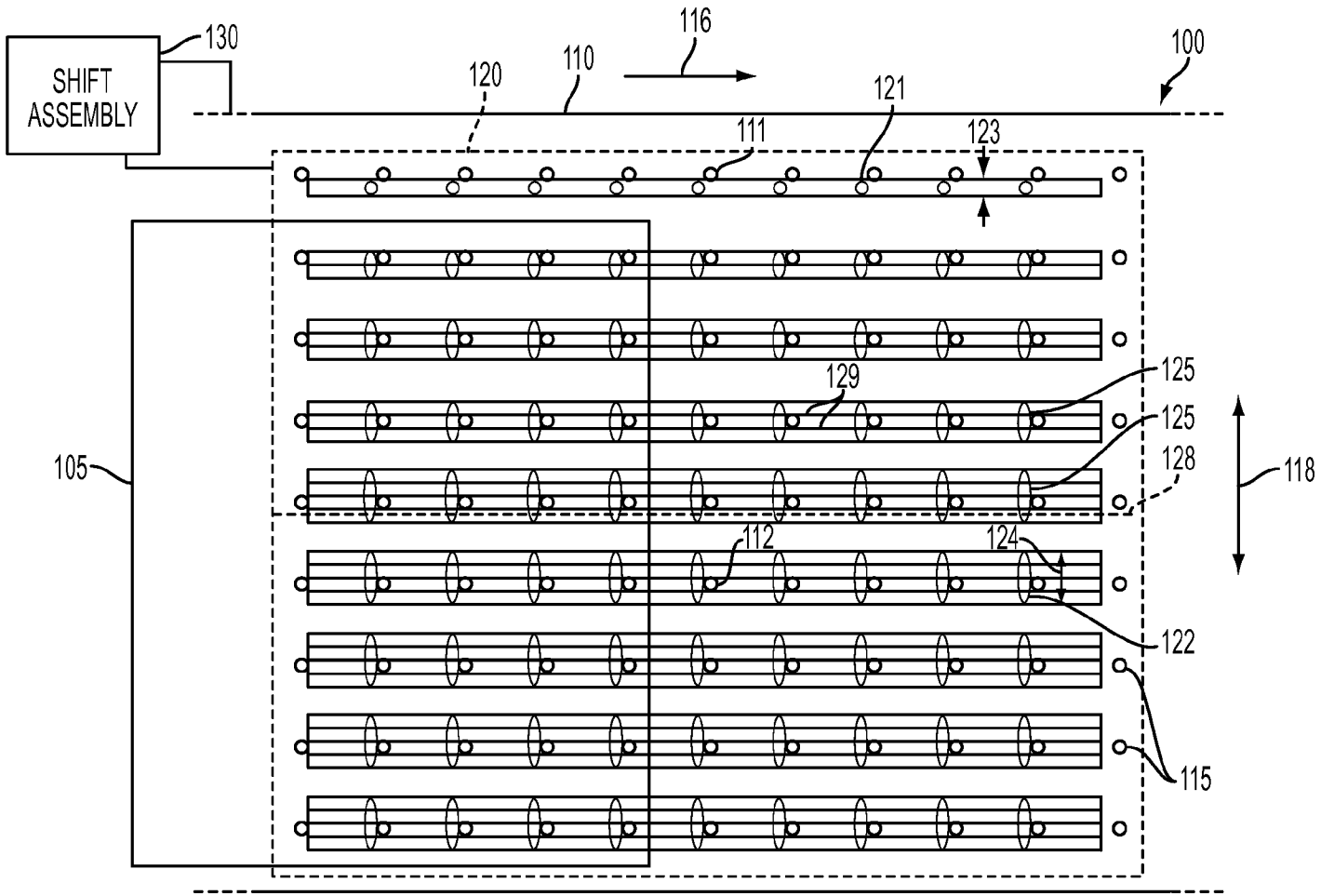
FIG. 1 is an exemplary top view illustration of an apparatus according to one embodiment.

The embodiments include an apparatus configured to provide media hold down transport air flow in an image production device. The apparatus can include a media transport belt configured to transport media sheets in a process direction. The media transport belt can include a plurality of belt apertures arranged along a cross-process direction, where the cross-process direction is perpendicular to the process direction. The plurality of belt apertures can be configured to conduct air to secure the media sheets on the media transport belt. The apparatus can include a vacuum plenum assembly. The vacuum plenum assembly can include a plurality of plenum apertures arranged along the cross-process direction. The plurality of plenum apertures can be configured to conduct air through at least some of the plurality of belt apertures. The plurality of plenum apertures can include at least a first plenum aperture of a first width in the cross-process direction and at least a second plenum aperture of a second width in the cross-process direction, where the first width can be different from the second width. The apparatus can include a media transport shift assembly configured to shift a relative position between the media transport belt and the vacuum plenum assembly in the cross-process direction to align at least some of the plurality of belt apertures with at least some of the plurality of plenum apertures.

The embodiments further include a method for media hold down transport air flow in an image production device having a media transport belt configured to transport media sheets in a process direction. The media transport belt can include a plurality of belt apertures arranged along a cross-process direction, where the cross-process direction is perpendicular to the process direction. The image production machine can have a vacuum plenum assembly. The vacuum plenum assembly can include a plurality of plenum apertures arranged along the cross-process direction. The method can include transporting media sheets in the process direction by moving the media transport belt around the vacuum plenum assembly. The method can include shifting a relative position between the media transport belt and the vacuum plenum assembly in the cross-process direction to change an alignment between at least some of the plurality of belt apertures and at least some of the plurality of plenum apertures. The method can include conducting pressurized airflow via at least some of the plurality of belt apertures and some of the plenum apertures to secure the media sheets on the media transport belt.

The embodiments further include an apparatus configured to provide air flow for a media hold down transport. The apparatus can include a media transport belt configured to transport media sheets in a process direction in an image production machine. The media transport belt can include a plurality of belt apertures arranged along a cross-process direction, where the cross-process direction is perpendicular to the process direction. The plurality of belt apertures can be configured to conduct air to secure the media sheets on the media transport belt. The apparatus can include a vacuum plenum assembly. The media transport belt can move around the vacuum plenum assembly. The vacuum plenum assembly can include a plurality of plenum apertures arranged along the cross-process direction. The plurality of plenum apertures can be configured to conduct air. The plurality of plenum apertures can include at least a first plenum aperture of a first width in the cross-process direction and at least a second plenum aperture of a second width in the cross-process direction. The first width can be different from the second width. The vacuum plenum assembly can include a vacuum plenum assembly center in the cross-process direction, where the first plenum aperture can be distal to the vacuum plenum assembly center in at least one direction relative to the second plenum aperture, and where the first width of the first plenum aperture can be narrower than the second width of the second plenum aperture. The apparatus can include a media transport shift assembly that can shift a relative position between the media transport belt and the vacuum plenum assembly in the cross-process direction to close least a first of the plurality of belt apertures by shifting the first of the plurality of belt apertures away from the first plenum aperture.

FIG. 1 is an exemplary top view illustration of an apparatus 100 according to one embodiment. The apparatus 100 may be a document feeder, a printer, a scanner, a multifunction media device, a xerographic machine, or any other device that transports media. The apparatus 100 can include a media transport belt 110 configured to transport media sheets 105 in a process direction 116 in an image production machine. Only a section of the media transport belt 110 is shown. The media transport belt 110 can include a plurality of belt apertures 115 arranged along a cross-process direction 118, where the cross-process direction 118 is perpendicular to the process direction 116. The plurality of belt apertures 115 can be configured to conduct air to secure the media sheets 105 on the media transport belt 110.

As an example of operation, the media transport belt 110 can be mounted onto and driven by a belt support and drive assembly or belt module (not shown) that can include a series of rollers or bars. In operation of the apparatus 100, the media transport belt 110 can advance in the process direction 116 to move successive portions of its external surface sequentially beneath one or more image production processing stations (not shown) disposed about a path of movement within an image production machine.

The apparatus 100 can include a vacuum plenum assembly 120 coupled to the media transport belt 110. The vacuum plenum assembly 120 can be situated inside the media transport belt 110 for applying vacuum pressure to the back side of media sheets 105 to produce images thereon. The vacuum plenum assembly 120 can act to attach the back side of the media sheets 105 to the media transport belt 110. The vacuum plenum assembly 120 can include a plurality of plenum apertures 125 arranged along the cross-process direction 118. The plurality of plenum apertures 125 can conduct air through at least some of the plurality of belt apertures 115. The plurality of plenum apertures 125 can include at least a first plenum aperture 121 of a first width 123 in the cross-process direction 118 and at least a second plenum aperture 122 of a second width 124 in the cross-process direction 118. The first width 123 can be different from the second width 124. Ribbed chambers 129 that run along the process direction 116 can be used to provide support for the media transport belt 110 and supply air to the plurality of plenum apertures 125.

The apparatus 100 can include a media transport shift assembly 130. The media transport shift assembly 130 can shift a relative position between the media transport belt 110 and the vacuum plenum assembly 120 in the cross-process direction 118 to align at least some of the plurality of belt apertures 115 with at least some of the plurality of plenum apertures 125. The media transport shift assembly 130 can shift the media transport belt 110 or the vacuum plenum assembly 120. The media transport shift assembly 130 can shift a relative position between the media transport belt 110 and the vacuum plenum assembly 120 in the cross-process direction 118 to open and close least some of the plurality of belt apertures 115 by aligning at least some of the plurality of belt apertures 115 with at least some of the plurality of plenum apertures 125.

The vacuum plenum assembly 120 can include a vacuum plenum assembly center 128 in the cross-process direction 118. The first plenum aperture 121 can be distal to the vacuum plenum assembly center 128 in at least one direction in the cross-process direction 118 from the vacuum plenum assembly center 128 relative to the second plenum aperture 122. The first width 123 of the first plenum aperture 121 can be narrower than the second width 124 of the second plenum aperture 122. Some plenum apertures distal to the vacuum plenum assembly center 128 in at least one direction can be narrower than plenum apertures closer to the vacuum plenum assembly center 128 and/or narrower than at least some plenum apertures in another direction. Plenum apertures in the other direction may also be narrower than plenum apertures closer to the vacuum plenum assembly center 128, but can also be the same size as and/or wider than plenum apertures closer to the vacuum plenum assembly center 128 depending on the size of the media transported on the media transport belt 110.

The media transport shift assembly 130 can shift a relative position between the media transport belt 110 and the vacuum plenum assembly 120 in the cross-process direction 118 to close least a first of the plurality of belt apertures 111 by shifting the first of the plurality of belt apertures 111 away from the first plenum aperture 121. When the media transport shift assembly 130 shifts a relative position between the media transport belt 110 and the vacuum plenum assembly 120 in the cross-process direction 118, it can maintain an opening between least a second of the plurality of belt apertures 112 and the second plenum aperture 122 while closing the first of the plurality of belt apertures 111.

The media transport shift assembly 130 can also shift a relative position between the media transport belt 110 and the vacuum plenum assembly 120 in the cross-process direction 118 to align at least some of the plurality of belt apertures 115, such as including the second of the plurality of belt apertures 112, with at least some of the plurality of plenum apertures 125 and to shift at least other of the plurality of belt apertures 115, such as including the first of the plurality of belt apertures 111, away from at least other of the plurality of plenum apertures 125. For example, the media transport shift assembly 130 can align at least some of the plurality of belt apertures 115 with at least some of the plurality of plenum apertures 125 and shift at least other of the plurality of belt apertures 115 away from at least other of the plurality of plenum apertures 125 depending on a size of a media sheet 105 transported by the media transport belt 110. As a further example, the media transport shift assembly 130 can shift a relative position between the media transport belt 110 and the vacuum plenum assembly 120 in the cross-process direction 118 to shift at least other of the plurality of belt apertures 115 away from at least other of the plurality of plenum apertures 125 based on a size of a media sheet 105 transported by the media transport belt 110 being smaller than other media sheets transported by the media transport belt 110.

Figure 2:
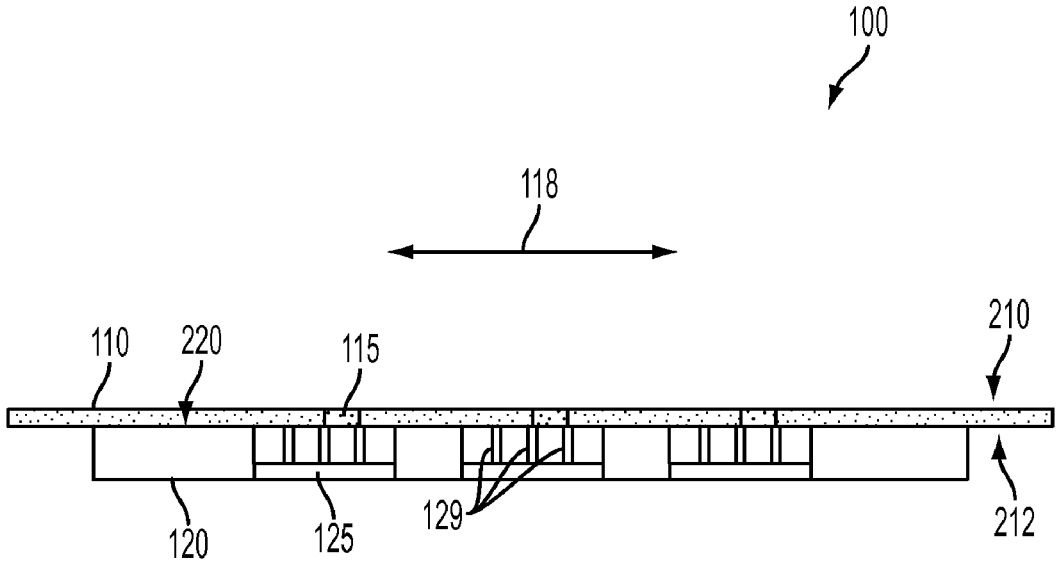
FIG. 2 is an exemplary side view illustration of an apparatus from a viewpoint taken parallel with a process direction.

FIG. 2 is an exemplary side view illustration of a portion of the apparatus 100 from a viewpoint taken parallel with, such as into or along with, a media transport belt process direction. The media transport belt 110 can include a first surface 210 configured to transport the media sheets and can include a second surface 212 coupled to the vacuum plenum assembly 120, where the plurality of belt apertures 115 are configured to direct pressurized airflow from the first surface 210 through to the second surface 212 or vice versa. The vacuum plenum assembly 120 can include a vacuum plenum assembly surface 220 coupled to the media transport belt second surface 212. Wide slotted areas of the vacuum plenum assembly 120 coupled to the plenum apertures 125 can be supported by using very narrow rib sections, such as the ribbed chambers 129, across them to provide adequate support to the media transport belt 110. The ribbed chambers 129 can be interconnected below the vacuum plenum assembly surface 220 to act as a common air port.

For example, the apparatus 100 can use a vacuum plenum, such as the vacuum plenum assembly 120, having different width air channels located under a transport belt, such as the media transport belt 110. The air channels can extend along the process direction of the transport belt. A common air supply (not shown) can be gated to appropriate belt hole cross process locations by traversing the vacuum plenum surface or the transport belt position in the cross process direction at various locations with respect to each other. Outward plenum slots corresponding to the plenum apertures 125 on at least one side of the vacuum plenum in the cross-process direction can be the narrowest and the slot width can progressively get wider at various media size intervals along the width of the vacuum plenum in the cross-process direction. For the widest media the outer belt holes, such as the belt apertures 115, can be located over the narrow slots of the plenum to provide an open port condition. As the media width is decreased the belt to plenum orientation is traversed to close off the far belt holes from the respective plenum slots. The wider slots can continue to provide air to the remaining series of holes. This can be repeated for the remaining smaller media widths by progressively traversing the belt-to-plenum position. This can eliminate open port cross process leakage and can maximize media hold down efficiency. Different vacuum plenum apertures can be used in different configurations for different media transport systems, such as edge or center registered transport systems.

The vacuum belt-to-plenum traversal can be done by either moving the belt or plenum position. For vacuum belt transport applications used to hold media flat under print heads, the media registration and motion may be important, and active belt steering can be used. In this case positioning the belt can become free. If maintaining the belt hole pattern location with respect to the transport is important, then plenum can be traversed using a stepper or servo motor. For systems having a media registration device prior to the transport, the media and image can be shifted to align to the belt.

Figure 3:
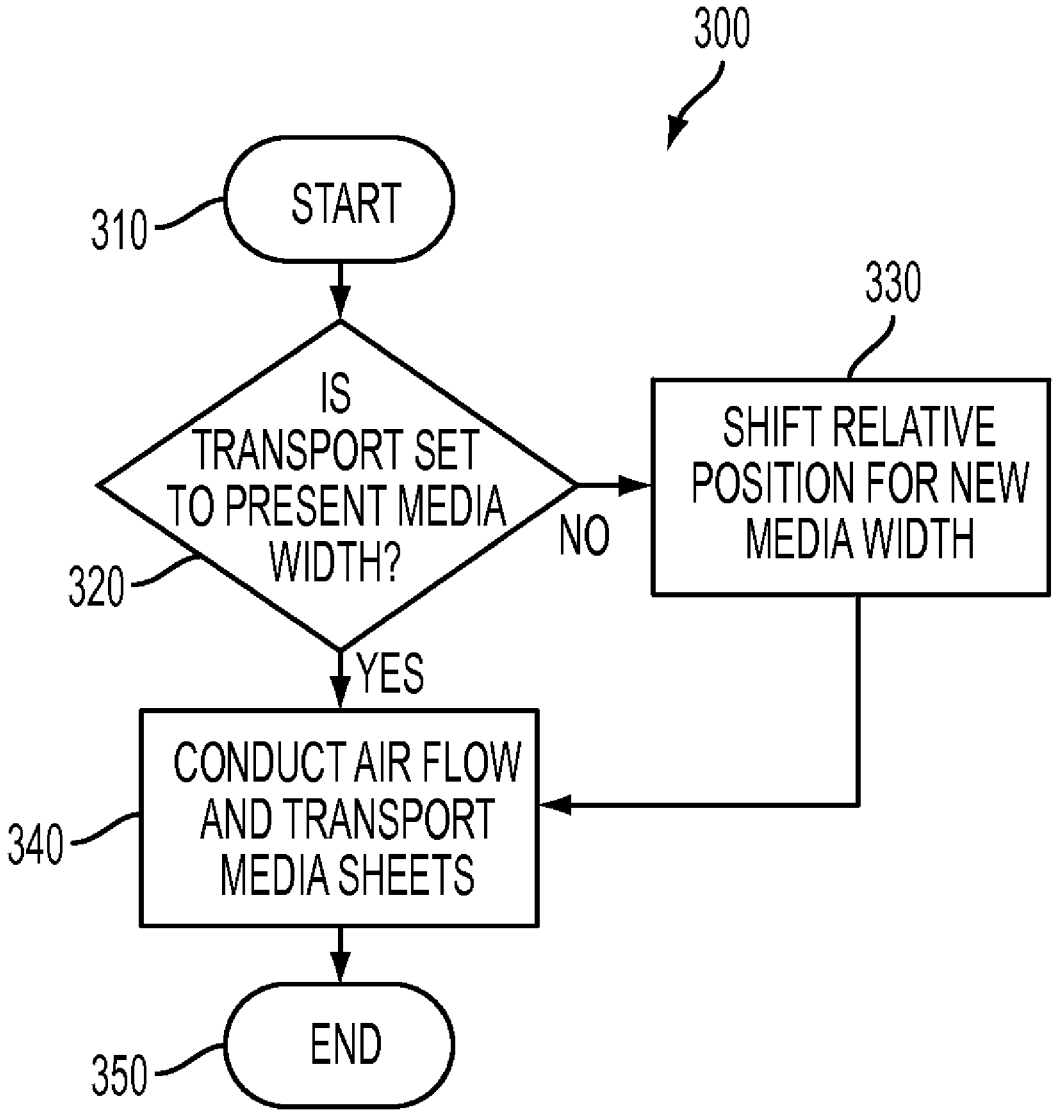
FIG. 3 illustrates an exemplary flowchart of a method for air flow in a media hold down transport in an image production machine according to one embodiment.

FIG. 3 illustrates an exemplary flowchart 300 of a method for air flow in a media hold down transport in an image production machine according to one embodiment. The image production machine can include a media transport belt configured to transport media sheets in a process direction. The media transport belt can include a plurality of belt apertures arranged along a cross-process direction, where the cross-process direction is perpendicular to the process direction. The image production machine can include a vacuum plenum assembly coupled to the media transport belt. The vacuum plenum assembly can include a plurality of plenum apertures arranged along the cross-process direction. The plurality of plenum apertures can include at least a first plenum aperture of a first width in the cross-process direction and at least a second plenum aperture of a second width in the cross-process direction, where the first width is different from the second width.

The method starts at 310. At 320, the media width to be transported is compared to the present transport belt position relative to the platen assembly. If correctly positioned, at 340, pressurized airflow is conducted via at least some of the plurality of belt apertures and some of the plenum apertures to secure media sheets transported on the media transport belt. Media sheets are transported in the process direction by moving the media transport belt around the vacuum plenum assembly. If media width is different, at 330, a relative position between the media transport belt and the vacuum plenum assembly is shifted in the cross-process direction to change an alignment between at least some of the plurality of belt apertures and at least some of the plurality of plenum apertures. The relative position can be shifted before or after media sheets are transported. For example, media sheets of a first size can be transported and the relative position can be shifted to transport media sheets of a second size.

The relative position between the media transport belt and the vacuum plenum assembly can be shifted in the cross-process direction to close least a first of the plurality of belt apertures by shifting the first of the plurality of belt apertures away from the first plenum aperture. The relative position between can be shifted in the cross-process direction to maintain an opening between least a second of the plurality of belt apertures and the second plenum aperture while closing the first of the plurality of belt apertures. The relative position can be shifted in the cross-process direction to open and close least some of the plurality of belt apertures by aligning at least some of the plurality of belt apertures with at least some of the plurality of plenum apertures. The relative position can be shifted in the cross-process direction to align at least some of the plurality of belt apertures with at least some of the plurality of plenum apertures and to shift at least other of the plurality of belt apertures away from at least other of the plurality of plenum apertures depending on a size of a media sheet transported by the media transport belt.

At 340, pressurized airflow is conducted via at least some of the plurality of belt apertures and some of the plenum apertures to secure media sheets transported on the media transport belt. Media sheets are transported in the process direction by moving the media transport belt around the vacuum plenum assembly. At 350, the flowchart 300 ends.

Figure 4:
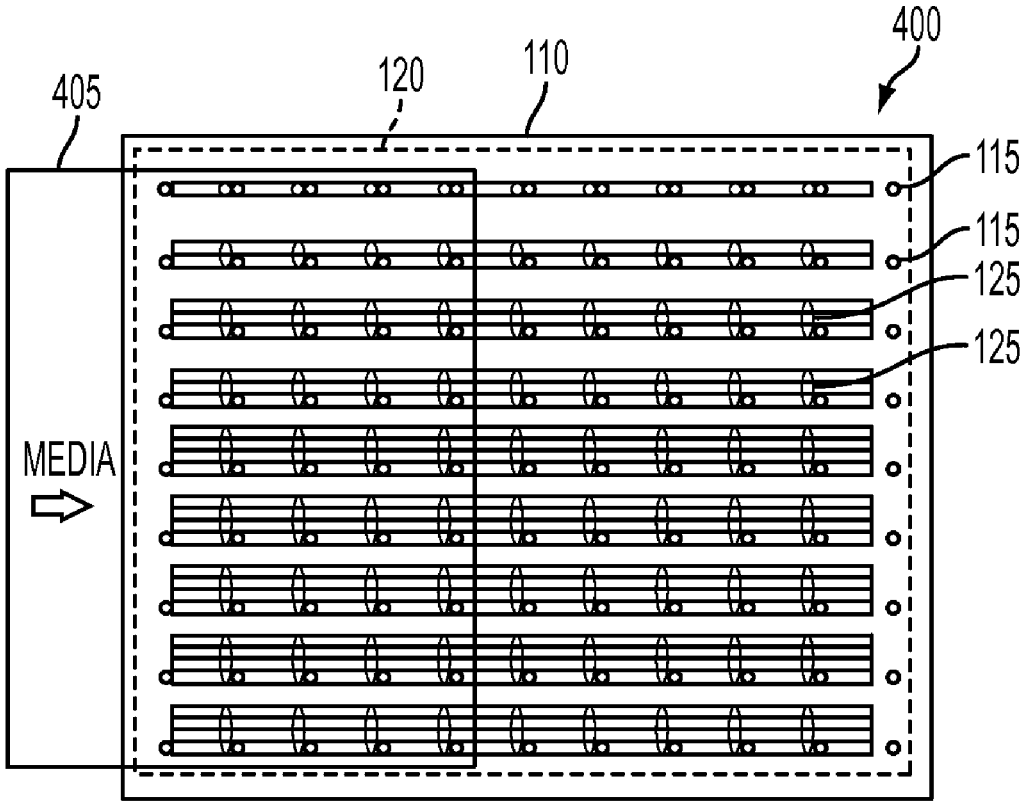
FIG. 4 is an exemplary illustration of an apparatus according to one embodiment.

FIG. 4 is an exemplary illustration of an apparatus 400, such as the apparatus 100, according to one embodiment. The apparatus 400 illustrates vacuum plenum assembly 120-to-media transport belt 110 positioning for widest media 405, such as 14" wide media, on the media transport belt 110 and the plurality of belt apertures 115 and the plurality of plenum apertures 125 for an example edge registered transport embodiment.

Figure 5:
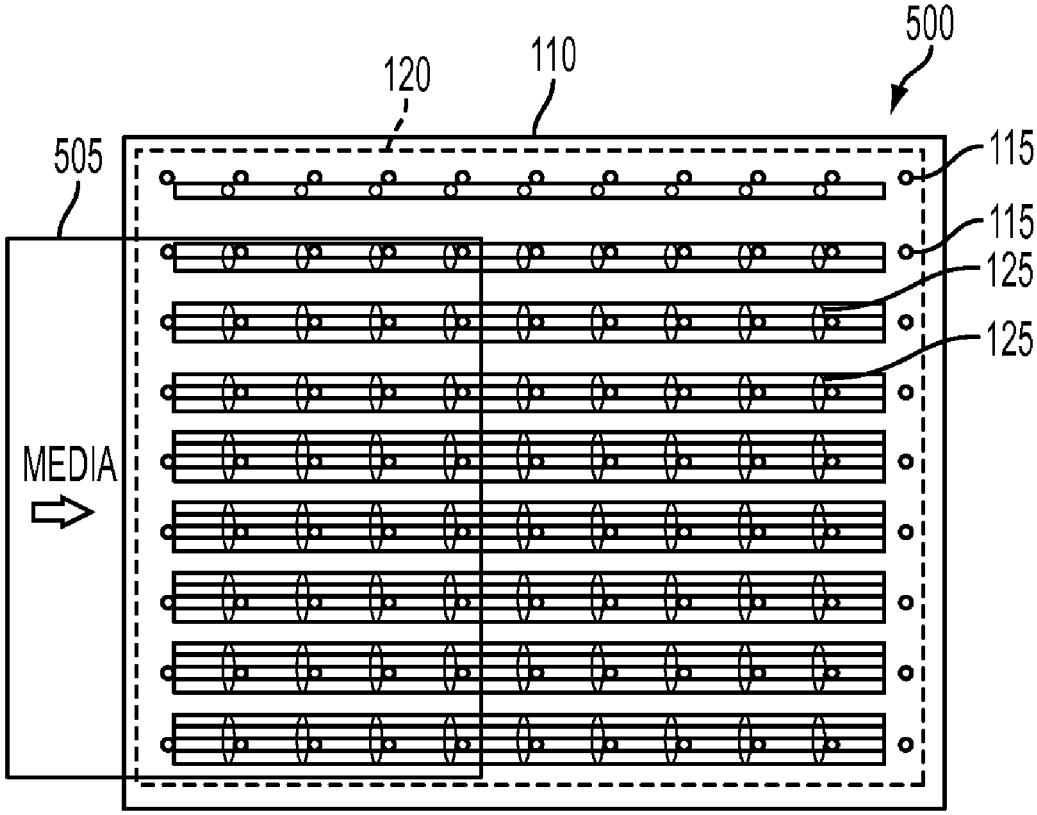
FIG. 5 is an exemplary illustration of an apparatus according to one embodiment.

FIG. 5 is an exemplary illustration of an apparatus 500, such as the apparatus 100, according to one embodiment. The apparatus 500 illustrates vacuum plenum assembly 120-to-media transport belt 110 positioning for next widest media 505, such as 11" wide media, on the media transport belt 110. A relative position between the media transport belt 110 and the vacuum plenum assembly 120 can be shifted to maintain an opening between some of the plurality of belt apertures 115 and some of the plurality of plenum apertures 125 while closing others of the plurality of belt apertures 115 to hold down the next widest media 505.

Figure 6:
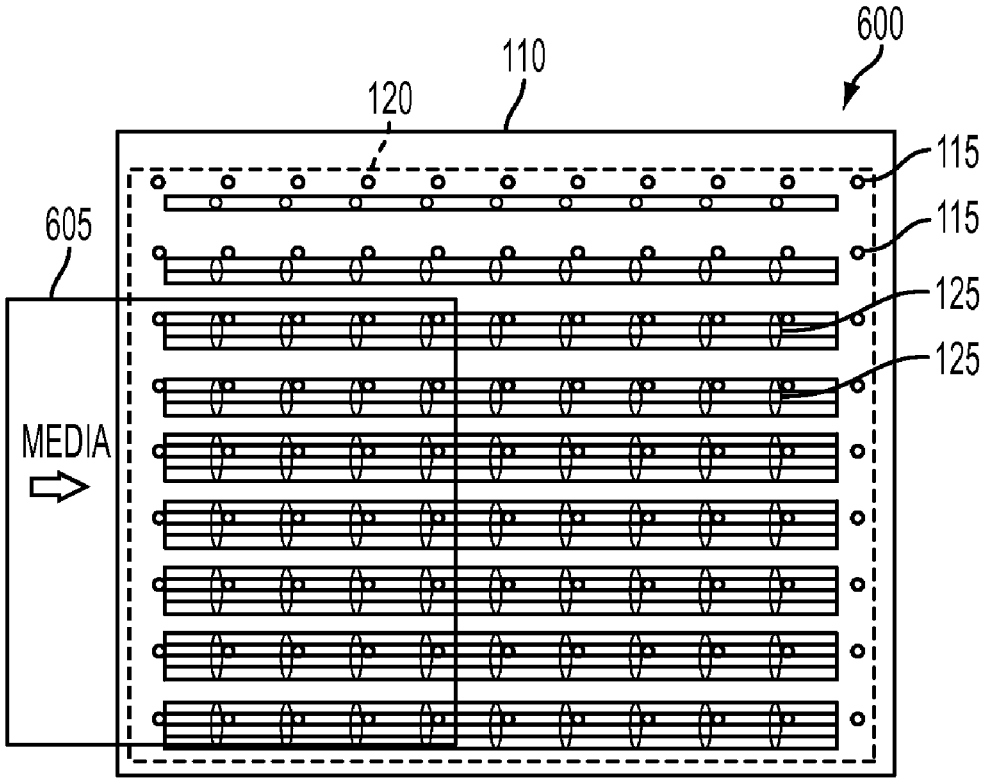
FIG. 6 is an exemplary illustration of an apparatus according to one embodiment.

FIG. 6 is an exemplary illustration of an apparatus 600, such as the apparatus 100, according to one embodiment. The apparatus 600 illustrates vacuum plenum assembly 120-to-media transport belt 110 positioning for smaller width media 605, such as 8.5" wide media, on the media transport belt 110. As with the illustration of the apparatus 500, a relative position between the media transport belt 110 and the vacuum plenum assembly 120 can be shifted to maintain an opening between some of the plurality of belt apertures 115 and some of the plurality of plenum apertures 125 while closing others of the plurality of belt apertures 115 to hold down the smaller width media 605.

Figure 7:
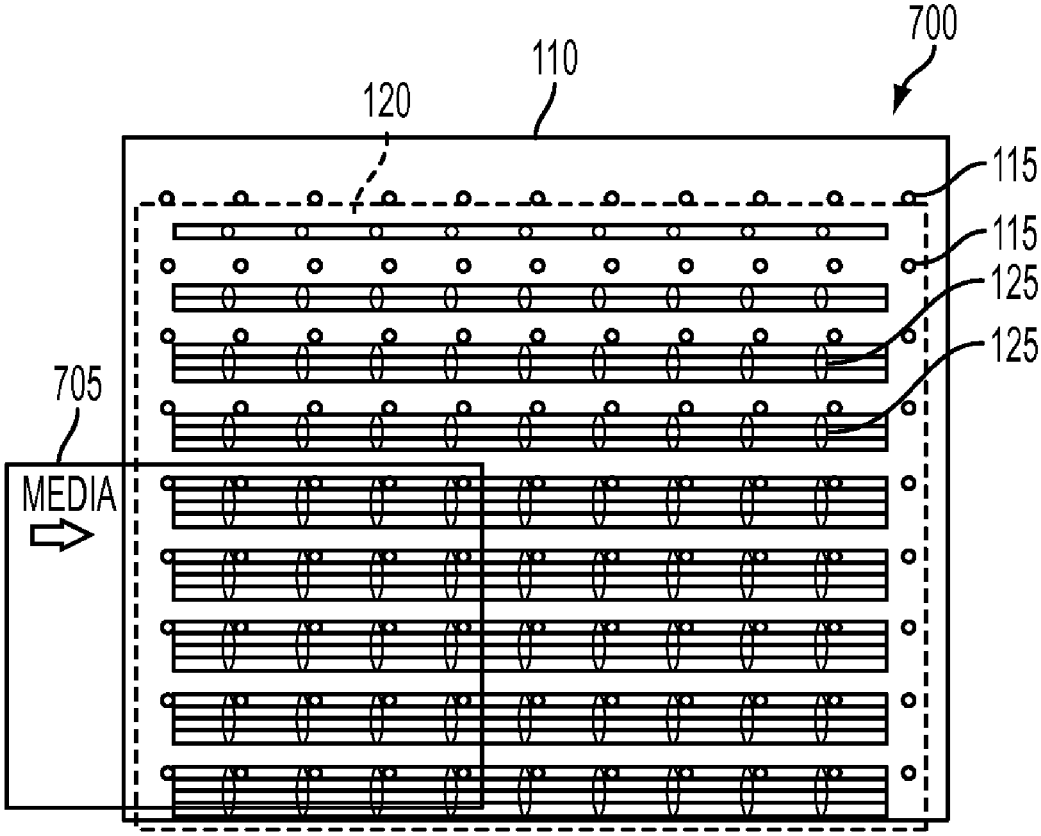
FIG. 7 is an exemplary illustration of an apparatus according to one embodiment.

FIG. 7 is an exemplary illustration of an apparatus 700, such as the apparatus 100, according to one embodiment. The apparatus 700 illustrates vacuum plenum assembly 120-to-media transport belt 110 positioning for small width media 705, such as 7" wide media, on the media transport belt 110. As with the illustration of the apparatus 500 and the apparatus 600, a relative position between the media transport belt 110 and the vacuum plenum assembly 120 can be shifted to maintain an opening between some of the plurality of belt apertures 115 and some of the plurality of plenum apertures 125 while closing others of the plurality of belt apertures 115.

Figure 8:
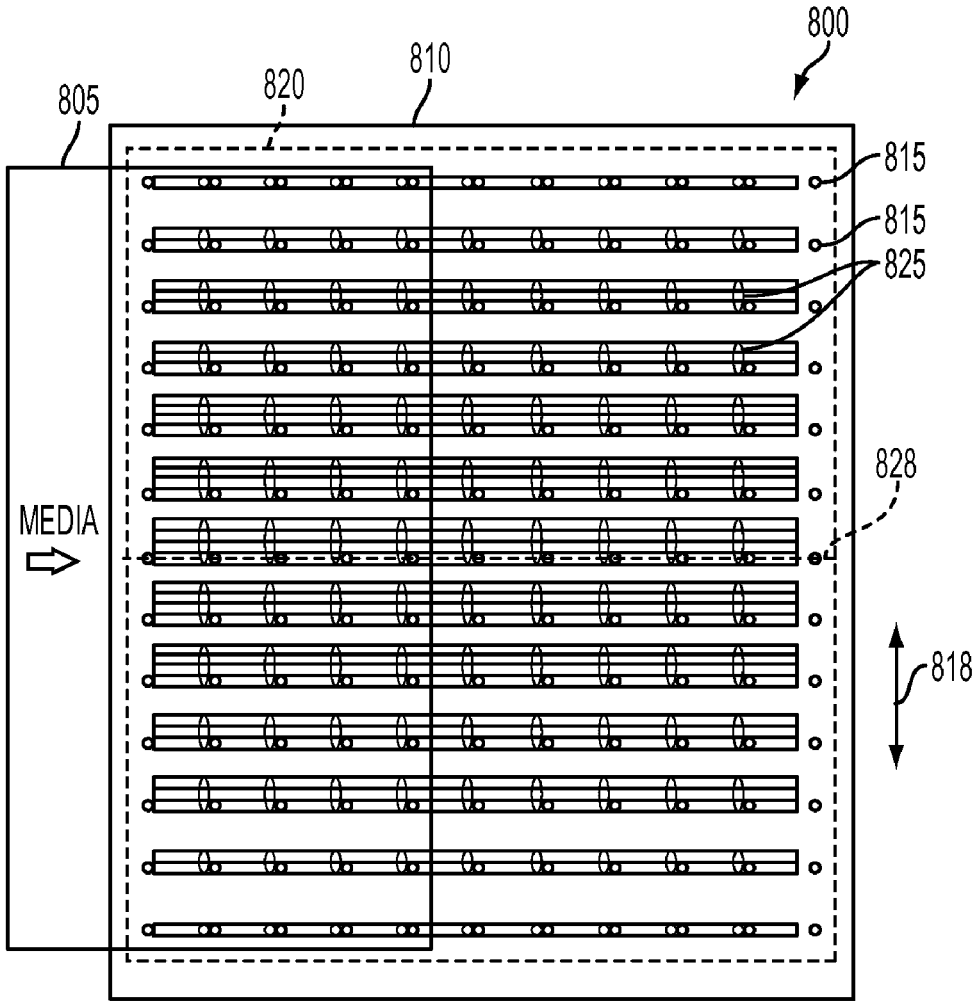
FIG. 8 is an exemplary illustration of an apparatus according to one embodiment.

FIG. 8 is an exemplary illustration of an apparatus 800 according to one embodiment. The apparatus 800 can include other features of the apparatus 100, which are not shown in the illustration. A vacuum plenum assembly 820 can include a vacuum plenum assembly center 828 in a cross-process direction 818. Some of the plurality of plenum apertures 825 distal to the vacuum plenum assembly center 828 in both directions from the vacuum plenum assembly center 828 can be narrower than other of the plurality of plenum apertures 825 more proximal to the vacuum plenum assembly center 828. The apparatus 800 illustrates vacuum plenum assembly 820-to-media transport belt 810 positioning for widest media 805, such as 14" wide media, on the media transport belt 810 and the plurality of belt apertures 815 and the plurality of plenum apertures 825 for an example center registered transport embodiment.

Figure 9:
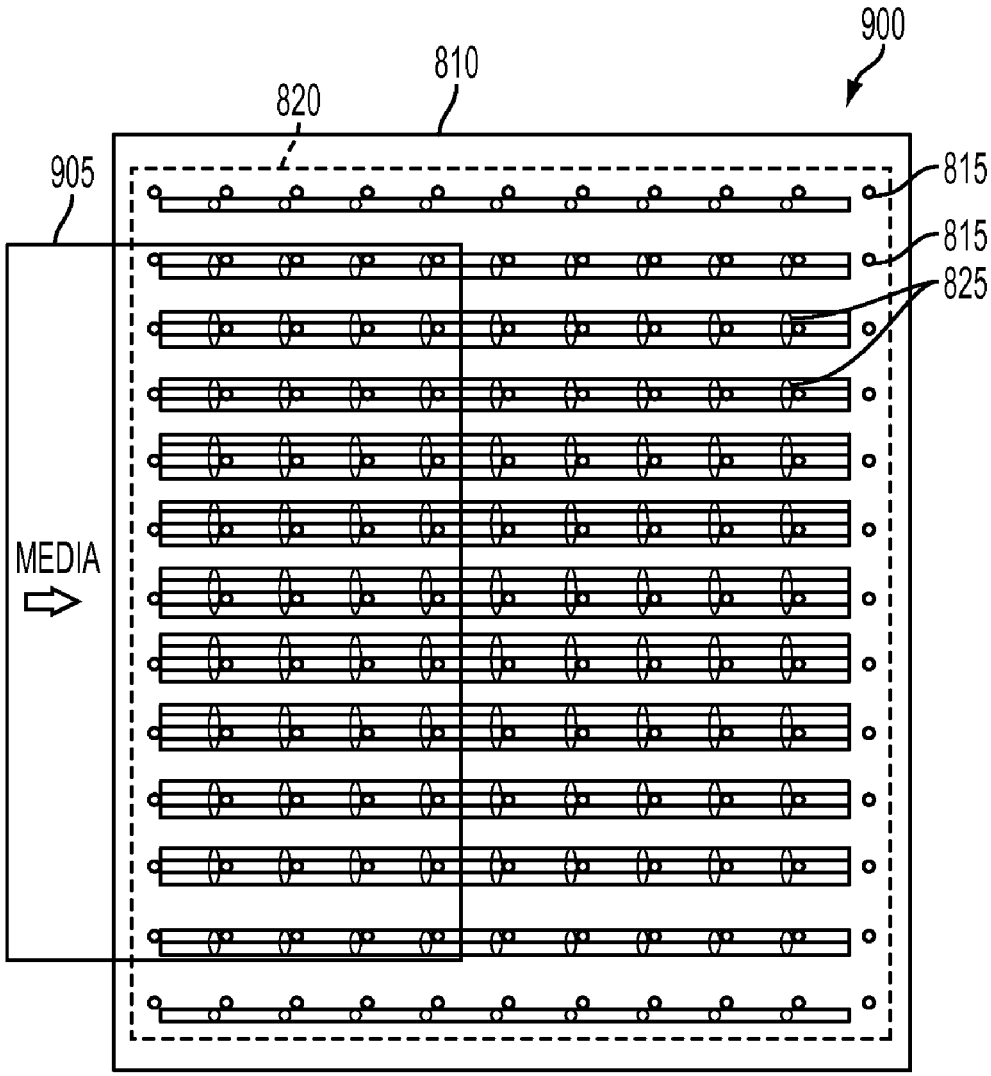
FIG. 9 is an exemplary illustration of an apparatus according to one embodiment.

FIG. 9 is an exemplary illustration of an apparatus 900, such as the apparatus 800, according to one embodiment. The apparatus 900 illustrates vacuum plenum assembly 820-to-media transport belt 810 positioning for next widest media 905, such as 11" wide media, on the media transport belt 810. A relative position between the media transport belt 810 and the vacuum plenum assembly 820 can be shifted to maintain an opening between some of the plurality of belt apertures 815 and some of the plurality of plenum apertures 825 while closing others of the plurality of belt apertures 815 to hold down the next widest media 905.

Figure 10:
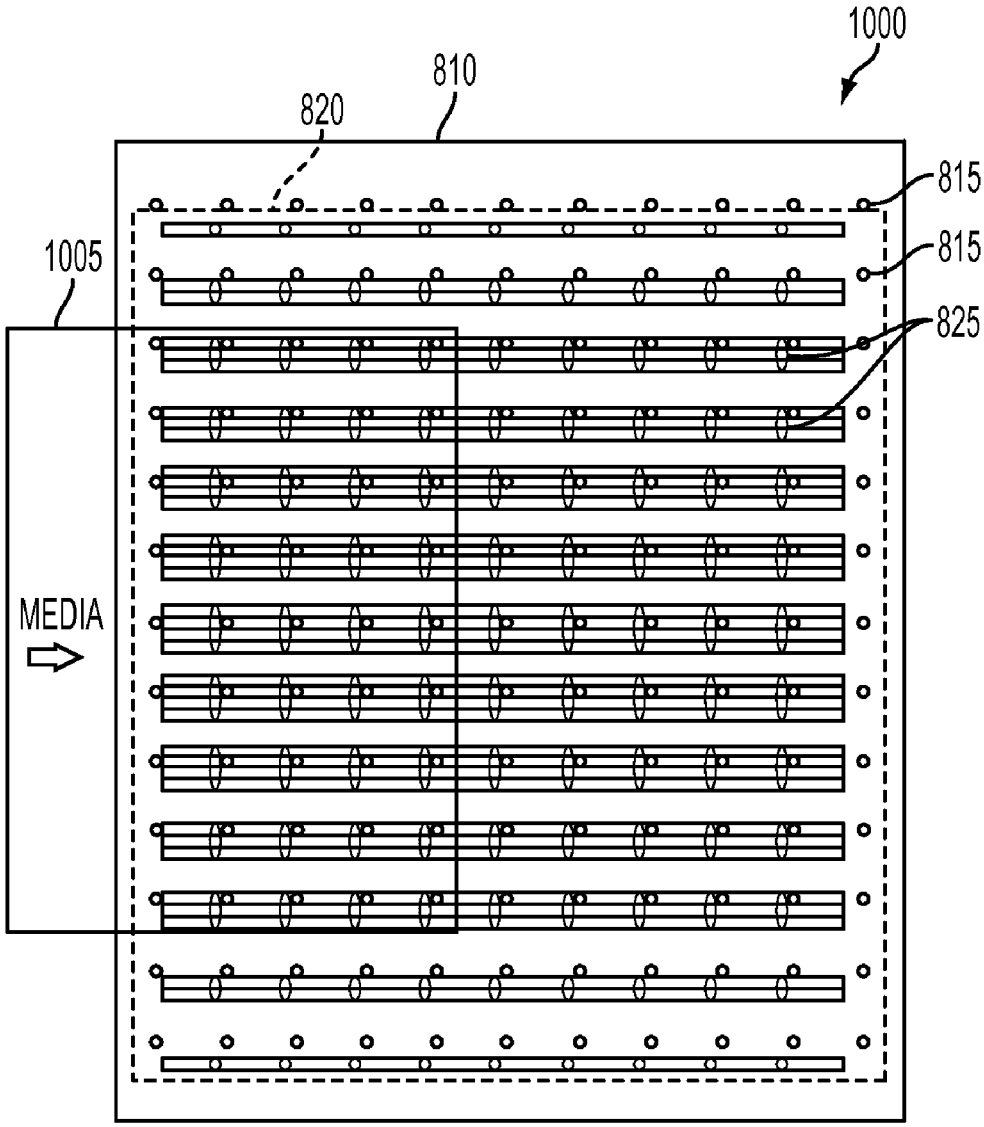
FIG. 10 is an exemplary illustration of an apparatus according to one embodiment.

FIG. 10 is an exemplary illustration of an apparatus 1000, such as the apparatus 800, according to one embodiment. The apparatus 1000 illustrates vacuum plenum assembly 820-to-media transport belt 810 positioning for smaller width media 1005, such as 8.5" wide media, on the media transport belt 810. A relative position between the media transport belt 810 and the vacuum plenum assembly 820 can be shifted to maintain an opening between some of the plurality of belt apertures 815 and some of the plurality of plenum apertures 825 while closing others of the plurality of belt apertures 815 to hold down the smaller width media 1005.

Figure 11:
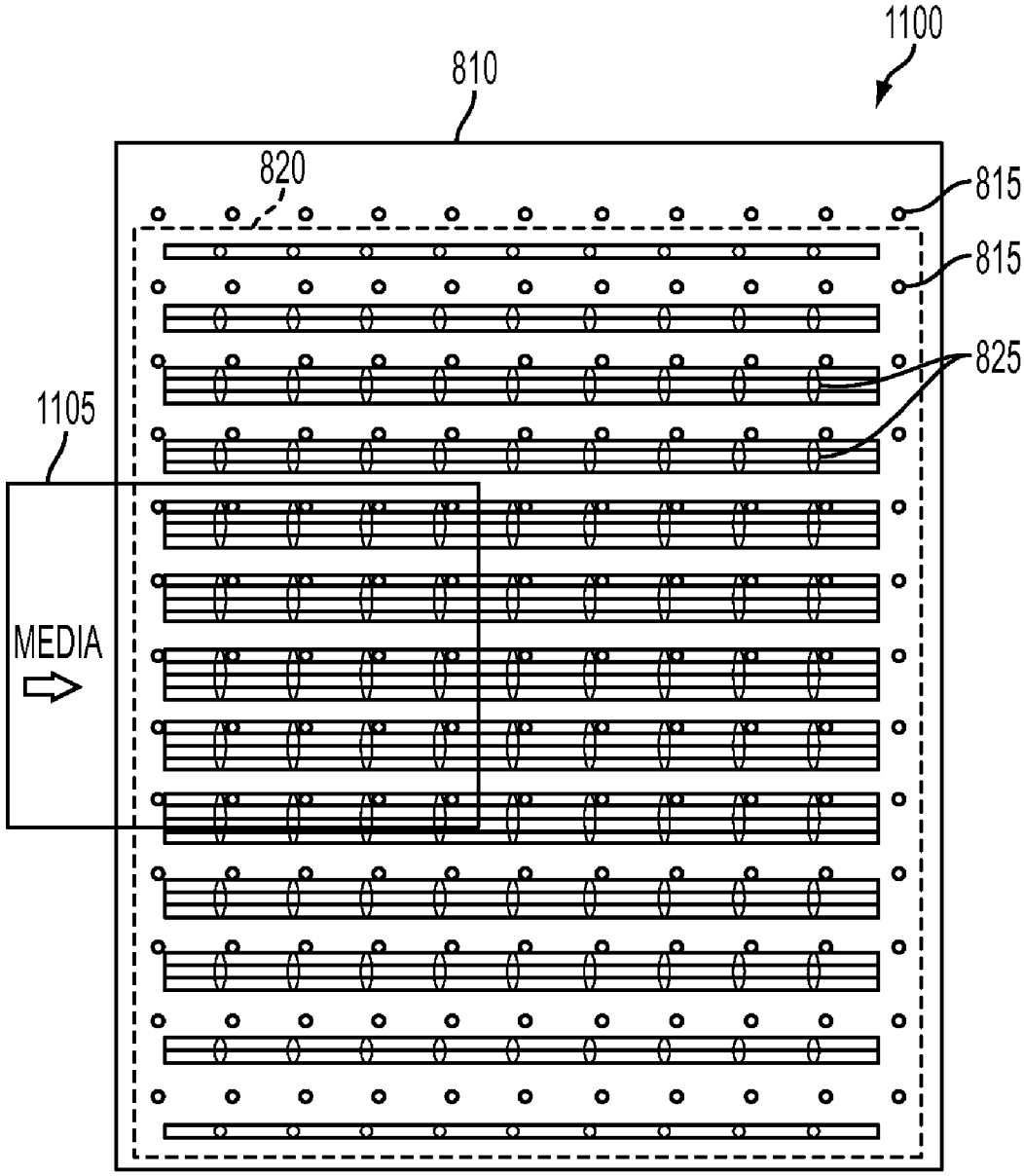
FIG. 11 is an exemplary illustration of an apparatus according to one embodiment.

FIG. 11 is an exemplary illustration of an apparatus 1100, such as the apparatus 800, according to one embodiment. The apparatus 1100 illustrates vacuum plenum assembly 820-to-media transport belt 810 positioning for small width media 1105, such as 7" wide media, on the media transport belt 810. A relative position between the media transport belt 810 and the vacuum plenum assembly 820 can be shifted to maintain an opening between some of the plurality of belt apertures 815 and some of the plurality of plenum apertures 825 while closing others of the plurality of belt apertures 815 to hold down the small width media 1105.

Figure 12:
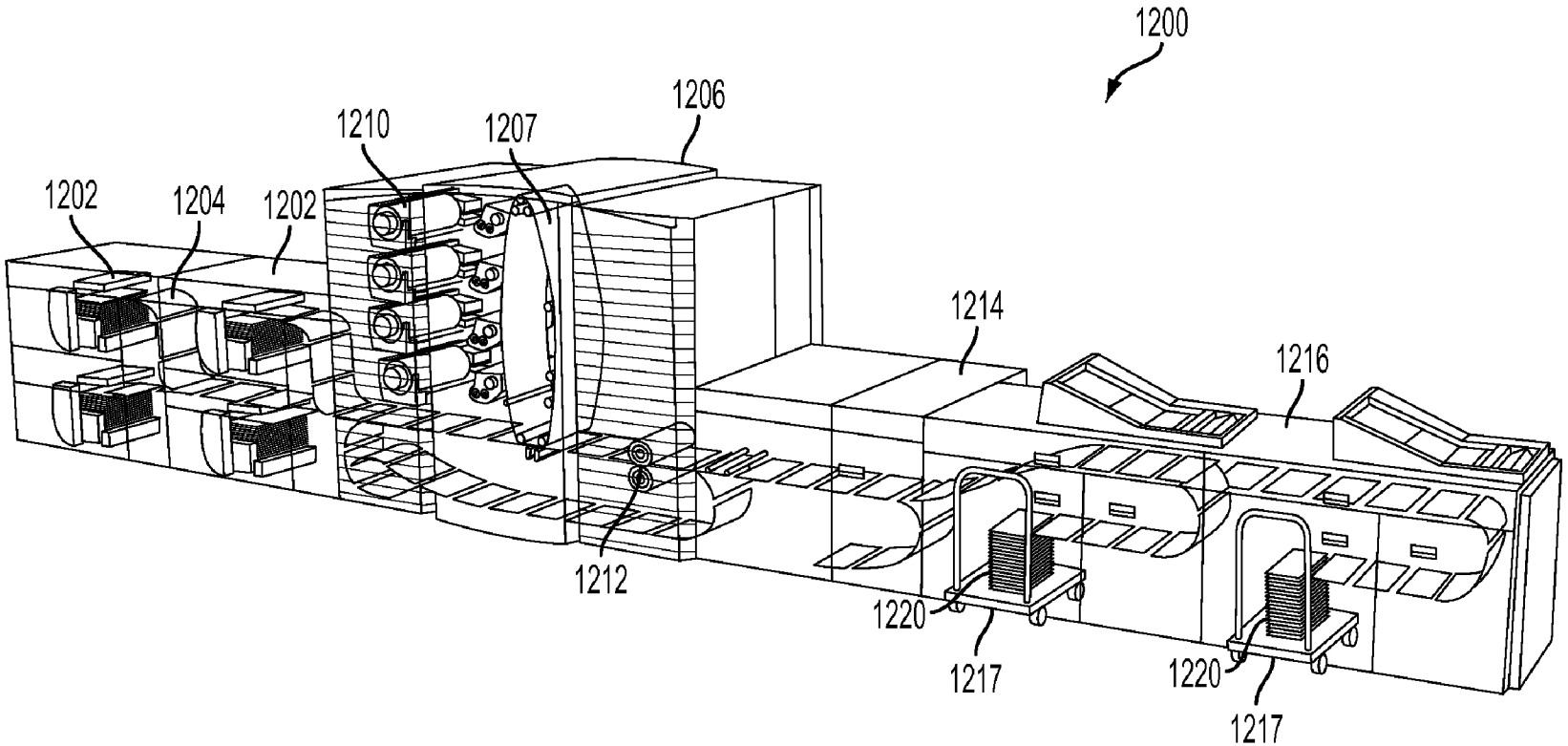
FIG. 12 illustrates an exemplary printing apparatus according to one embodiment.

FIG. 12 illustrates an exemplary printing apparatus 1200 according to one embodiment. As used herein, the term "printing apparatus" encompasses any apparatus, such as a digital copier, bookmaking machine, multifunction machine, and other printing devices that perform a print outputting function for any purpose. The printing apparatus 1200 can be used to produce prints from various media, such as coated, uncoated, previously marked, or plain paper sheets. The media can have various sizes and weights. In some embodiments, the printing apparatus 1200 can have a modular construction. As shown, the printing apparatus 1200 can include at least one media feeder module 1202, a printer module 1206 adjacent the media feeder module 1202, an inverter module 1214 adjacent the printer module 1206, and at least one stacker module 1216 adjacent the inverter module 1214.

In the printing apparatus 1200, the media feeder module 1202 can be adapted to feed media 1204 having various sizes, widths, lengths, and weights to the printer module 1206. The media can travel throughout any portion of the printing apparatus 1200 using the apparatus 100, the apparatus 800, or a similar apparatus depending on the required implementation. In the printer module 1206, toner is transferred from an arrangement of developer stations 1210 to a charged photoreceptor belt 1207 to form toner images on the photoreceptor belt 1207. The toner images are transferred to the media 1204 fed through a paper path. The media 1204 are advanced through a fuser 1212 adapted to fuse the toner images on the media 1204. The inverter module 1214 manipulates the media 1204 exiting the printer module 1206 by either passing the media 1204 through to the stacker module 1216, or by inverting and returning the media 1204 to the printer module 1206. In the stacker module 1216, printed media are loaded onto stacker carts 1217 to form stacks 1220.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

I claim:

1. An apparatus comprising:

a media transport belt configured to transport media sheets in a process direction in an image production machine, the media transport belt including a plurality of belt apertures arranged along a cross-process direction, the cross-process direction perpendicular to the process direction, the plurality of belt apertures configured to conduct air to secure the media sheets on the media transport belt;

a vacuum plenum assembly, the vacuum plenum assembly including a plurality of plenum apertures arranged along the cross-process direction, the plurality of plenum apertures configured to conduct air through at least some of the plurality of belt apertures, the plurality of plenum apertures including at least a first plenum aperture of a first width in the cross-process direction and at least a second plenum aperture of a second width in the cross-process direction, the first width different from the second width; and a media transport shift assembly configured to shift a relative position between the media transport belt and the vacuum plenum assembly in the cross-process direction to align at least some of the plurality of belt apertures with at least some of the plurality of plenum apertures.

2. The apparatus according to claim 1, wherein the media transport shift assembly is configured to shift a relative position between the media transport belt and the vacuum plenum assembly in the cross-process direction to open and close least some of the plurality of belt apertures by aligning at least some of the plurality of belt apertures with at least some of the plurality of plenum apertures.

3. The apparatus according to claim 1, wherein the vacuum plenum assembly includes a vacuum plenum assembly center in the cross-process direction, wherein the first plenum aperture is distal to the vacuum plenum assembly center in at least one direction relative to the second plenum aperture, and wherein the first width of the first plenum aperture is narrower than the second width of the second plenum aperture.

4. The apparatus according to claim 3, wherein the media transport shift assembly is configured to shift a relative position between the media transport belt and the vacuum plenum assembly in the cross-process direction to close least a first of the plurality of belt apertures by shifting the first of the plurality of belt apertures away from the first plenum aperture.

5. The apparatus according to claim 4, wherein the media transport shift assembly is configured to shift a relative position between the media transport belt and the vacuum plenum assembly in the cross-process direction to maintain an opening between least a second of the plurality of belt apertures and the second plenum aperture while closing the first of the plurality of belt apertures.

6. The apparatus according to claim 1, wherein the media transport belt includes a first surface configured to transport the media sheets and includes a second surface coupled to the vacuum plenum assembly, where the plurality of belt apertures are configured to direct pressurized airflow from the first surface through to the second surface.

7. The apparatus according to claim 1, wherein the media transport shift assembly is configured to shift a relative position between the media transport belt and the vacuum plenum assembly in the cross-process direction to align at least some of the plurality of belt apertures with at least some of the plurality of plenum apertures and to shift at least other of the plurality of belt apertures away from at least other of the plurality of plenum apertures.

8. The apparatus according to claim 1, wherein the media transport shift assembly is configured to shift a relative position between the media transport belt and the vacuum plenum assembly in the cross-process direction to align at least some of the plurality of belt apertures with at least some of the plurality of plenum apertures and to shift at least other of the plurality of belt apertures away from at least other of the plurality of plenum apertures depending on a size of a media sheet transported by the media transport belt.

9. The apparatus according to claim 8, wherein the media transport shift assembly is configured to shift a relative position between the media transport belt and the vacuum plenum assembly in the cross-process direction to shift at least other of the plurality of belt apertures away from at least other of the plurality of plenum apertures based on a size of a media sheet transported by the media transport belt being smaller than other media sheets transported by the media transport belt.

10. A method in an image production machine including a media transport belt configured to transport media sheets in a process direction, the media transport belt including a plurality of belt apertures arranged along a cross-process direction, the cross-process direction perpendicular to the process direction, the image production machine including a vacuum plenum assembly, the vacuum plenum assembly including a plurality of plenum apertures arranged along the cross-process direction, the method comprising:

transporting media sheets in the process direction by moving the media transport belt around the vacuum plenum assembly;

shifting a relative position between the media transport belt and the vacuum plenum assembly in the cross-process direction to change an alignment between at least some of the plurality of belt apertures and at least some of the plurality of plenum apertures; and conducting pressurized airflow via at least some of the plurality of belt apertures and some of the plenum apertures to secure the media sheets on the media transport belt, wherein the plurality of plenum apertures include at least a first plenum aperture of a first width in the cross-process direction and at least a second plenum aperture of a second width in the cross-process direction, the first width different from the second width.

11. The method according to claim 10, wherein the vacuum plenum assembly includes a vacuum plenum assembly center in the cross-process direction, wherein the first plenum aperture is distal to the vacuum plenum assembly center in at least one direction relative to the second plenum aperture, and wherein the first width of the first plenum aperture is narrower than the second width of the second plenum aperture.

12. The method according to claim 11, wherein shifting a relative position comprises shifting a relative position between the media transport belt and the vacuum plenum assembly in the cross-process direction to close least a first of the plurality of belt apertures by shifting the first of the plurality of belt apertures away from the first plenum aperture.

13. The method according to claim 12, wherein shifting a relative position comprises shifting a relative position between the media transport belt and the vacuum plenum assembly in the cross-process direction to maintain an opening between least a second of the plurality of belt apertures and the second plenum aperture while closing the first of the plurality of belt apertures.

14. The method according to claim 10, wherein shifting a relative position comprises shifting a relative position between the media transport belt and the vacuum plenum assembly in the cross-process direction to open and close least some of the plurality of belt apertures by aligning at least some of the plurality of belt apertures with at least some of the plurality of plenum apertures.

15. The method according to claim 10, wherein the media transport belt includes a first surface configured to transport the media sheets and includes a second surface coupled to the vacuum plenum assembly, where the plurality of belt apertures are configured to direct pressurized airflow from the first surface through to the second surface.

16. The method according to claim 10, wherein shifting a relative position comprises shifting a relative position between the media transport belt and the vacuum plenum assembly in the cross-process direction to align at least some of the plurality of belt apertures with at least some of the plurality of plenum apertures and to shift at least other of the plurality of belt apertures away from at least other of the plurality of plenum apertures.

17. The method according to claim 10, wherein shifting a relative position comprises shifting a relative position between the media transport belt and the vacuum plenum assembly in the cross-process direction to align at least some of the plurality of belt apertures with at least some of the plurality of plenum apertures and to shift at least other of the plurality of belt apertures away from at least other of the plurality of plenum apertures depending on a size of a media sheet transported by the media transport belt.

18. An image production machine comprising:

a media transport belt configured to transport media sheets in a process direction in an image production machine, the media transport belt including a plurality of belt apertures arranged along a cross-process direction, the cross-process direction perpendicular to the process direction, the plurality of belt apertures configured to conduct air to secure the media sheets on the media transport belt;

a vacuum plenum assembly, where the media transport belt moves around the vacuum plenum assembly, the vacuum plenum assembly including a plurality of plenum apertures arranged along the cross-process direction, the plurality of plenum apertures configured to conduct air, the plurality of plenum apertures including at least a first plenum aperture of a first width in the cross-process direction and at least a second plenum aperture of a second width in the cross-process direction, the first width different from the second width, the vacuum plenum assembly including a vacuum plenum assembly center in the cross-process direction where the first plenum aperture is distal to the vacuum plenum assembly center in at least one direction from the vacuum plenum assembly center relative to the second plenum aperture, and where the first width of the first plenum aperture is narrower than the second width of the second plenum aperture; and a media transport shift assembly configured to shift a relative position between the media transport belt and the vacuum plenum assembly in the cross-process direction to close least a first of the plurality of belt apertures by shifting the first of the plurality of belt apertures away from the first plenum aperture.

19. The image production machine according to claim 18, wherein the media transport shift assembly is configured to shift a relative position between the media transport belt and the vacuum plenum assembly in the cross-process direction to maintain an opening between least a second of the plurality of belt apertures and the second plenum aperture while closing the first of the plurality of belt apertures.

* * * * *